US012692630B2

(12) United States Patent
Wang et al.

(10) Patent No.: US 12,692,630 B2
(45) Date of Patent: Jul. 28, 2026

(54) USE OF POLYMER COMPOSITION ON MAKING SOFT NONWOVEN FABRICS

(71) Applicant: BOREALIS AG, Vienna (AT)

(72) Inventors: Jingbo Wang, Linz (AT); Joachim Fiebig, Engerwitzdorf (AT); Henk Van Paridon, Beringen (BE); Gustaf Tobieson, Stenungsund (SE); Sebastian Sommer, Troisdorf (DE); Patrick Bohl, Hennef (DE); Hans-Georg Geus, Niederkassel (DE); Morten Rise Hansen, Aalborg (DK); Mathias Agersnap Scherer, Hampshire (DK); Thomas Broch, Gistrup (DK)

(73) Assignee: BOREALIS AG, Vienna (AT)

( * ) Notice: Subject to any disclaimer, the term of this patent is extended or adjusted under 35 U.S.C. 154(b) by 12 days.

(21) Appl. No.: 18/725,853

(22) PCT Filed: Dec. 21, 2022

(86) PCT No.: PCT/EP2022/087186
§ 371 (c)(1),
(2) Date: Jul. 1, 2024

(87) PCT Pub. No.: WO2023/131531
PCT Pub. Date: Jul. 13, 2023

(65) Prior Publication Data

US 2025/0059683 A1 Feb. 20, 2025

(30) Foreign Application Priority Data

Jan. 5, 2022 (EP) ..... 22150284

(51) Int. Cl.
*D01F 8/06* (2006.01)
*D01D 5/22* (2006.01)
(Continued)

(52) U.S. Cl.
CPC ..... *D01F 8/06* (2013.01); *D01D 5/22* (2013.01); *D01D 5/32* (2013.01); *D04H 1/4291* (2013.01);
(Continued)

(58) Field of Classification Search
CPC ..... B29C 70/081; B29C 59/025; B29C 53/22; B29C 51/145; B29C 70/543; B29C 70/16;
(Continued)

(56) References Cited

U.S. PATENT DOCUMENTS

2010/0261399 A1 10/2010 Katsuya et al.
2019/0233994 A1 8/2019 Sommer et al.

FOREIGN PATENT DOCUMENTS

EP 0887379 A 12/1998
EP 2343406 A1 7/2011
(Continued)

OTHER PUBLICATIONS

European Application No. 22150284.2 Extended European Search Report dated Jun. 10, 2022.
(Continued)

*Primary Examiner* — Stella K Yi
(74) *Attorney, Agent, or Firm* — Tarolli, Sundheim, Covell & Tummino LLP

(57) ABSTRACT

Use of polymer composition comprising a first propylene polymer A and a second propylene polymer B for producing crimped multicomponent fiber having a side by side cross-sectional configuration.

14 Claims, 4 Drawing Sheets

Figure 1:
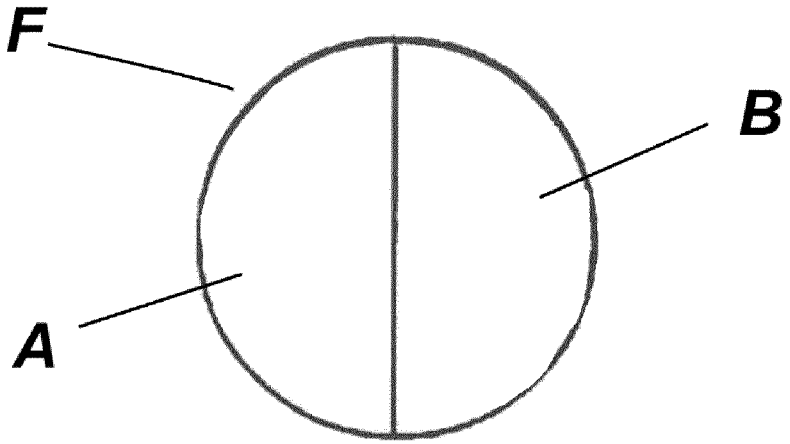

(51) Int. Cl.

| | |
|---|---|
| ***D01D 5/32*** | (2006.01) |
| ***D04H 1/4291*** | (2012.01) |
| ***D04H 1/4382*** | (2012.01) |
| ***D04H 1/4391*** | (2012.01) |
| ***D04H 1/558*** | (2012.01) |
| ***D04H 1/56*** | (2006.01) |
| ***D04H 3/16*** | (2006.01) |

(52) U.S. Cl.
CPC ..... *D04H 1/43832* (2020.05); *D04H 1/43918* (2020.05); *D04H 1/558* (2013.01); *D04H 1/56* (2013.01); *D04H 3/16* (2013.01); *D10B 2321/022* (2013.01)

(58) Field of Classification Search
CPC ... B29C 70/12; B29C 65/3636; B29C 65/364; B29C 65/344; B29C 65/3436; D01D 5/22; D04H 1/43918; D04H 1/43832
See application file for complete search history.

(56) References Cited

FOREIGN PATENT DOCUMENTS

| | | | |
|---|---|---|---|
| EP | 2999721 | B2 | 3/2016 |
| EP | 3184587 | B2 | 6/2017 |
| EP | 3202843 | A1 | 8/2017 |
| EP | 3246443 | A1 | 11/2017 |
| EP | 3246444 | B1 | 11/2017 |
| EP | 3321407 | A1 | 5/2018 |
| EP | 3521495 | A1 | 8/2019 |
| KR | 10-2019-0093155 | A | 8/2019 |
| KR | 10-2019-0093164 | A | 8/2019 |
| KR | 10-2021-0088717 | A | 7/2021 |
| WO | 1992/012182 | A1 | 7/1992 |
| WO | 1999/024478 | A1 | 5/1999 |
| WO | 1999/024479 | A1 | 5/1999 |
| WO | 2000/068315 | A1 | 11/2000 |
| WO | 2004/000899 | A1 | 12/2003 |
| WO | 2004/111095 | A1 | 12/2004 |
| WO | 2017/118612 | A1 | 7/2017 |
| WO | 2021/006527 | A1 | 1/2021 |
| WO | 2021/226246 | A1 | 11/2021 |

OTHER PUBLICATIONS

Zweifel, Hans, Plastics Additives Handbook, 5th Edition, 2001, 956-965.

Korean Application No. 10-2024-7025534, Office Action dated Apr. 20, 2026.

USE OF POLYMER COMPOSITION ON MAKING SOFT NONWOVEN FABRICS

The present invention is directed to use of a polymer composition for producing crimped multicomponent fiber having a side by side cross-sectional configuration.

Today, polypropylene fibers or polypropylene nonwoven fabrics have been used in a variety of applications, including filtration medium (filter), diapers, sanitary products, sanitary napkin, panty liner, incontinence product for adults, protective clothing materials, bandages, surgical drape, surgical gown, surgical wear and packing materials. Because of excellent properties such as breathability and softness, polypropylene nonwoven fabrics are widely used as hygiene materials. However, further improvements in softness, bulkiness and mechanical strength have been required.

High loft layers may contribute to the provision of nonwoven fabrics having a high softness as desired in hygiene products such as diapers, sanitary napkins and the like. Nonwoven fabrics comprising high loft layers on the basis of crimped fibers are known in the art. Generally, crimped multicomponent fibers comprise two or more polymers of different physical properties that are asymmetrically distributed over their cross section. The most common is side-by-side. This configuration causes the fibers to crimp when they are physically stressed like, in the case of spunbonded fibers, during fiber drawing and quenching.

For example, EP3246443A1 discloses a fabric comprising at least one high loft nonwoven layer having crimped multicomponent fibers, characterized in that a first component of the multicomponent fibers comprises a first polymer A and a second component of the multicomponent fibers comprises a blend of the first polymer A and a second polymer B, wherein the melt flow rate of polymer A is at least 25% different from the melt flow rate of polymer B and wherein the second component comprises at least 15 wt.-% of polymer B. Also the method of manufacturing the SMS type products are claimed.

EP3246444 shows a method for making a high loft nonwoven web comprising crimped multicomponent fibers, the process comprising laying down the fibers on a spinbelt and pre-consolidating the fibers after laydown using one or more pre-consolidation rollers to form a pre-consolidated web, characterized in that a first component of the fibers comprises a PP homopolymer and a second component of the fibers comprises a PP/PE copolymer, wherein the pre-consolidation rollers are operated at a certain temperature and contact force.

According to EP2343406, crimped conjugated fibers and nonwoven fabrics comprising the fibers are disclosed. The crimp of the fibers is thereby achieved upon using multicomponent fibers where the two components have similar melt flow rates and melting points, but a certain difference in the ratio of Z-average to weight average molecular weight distributions.

Despite these various improvements, however, there is still a need for optimization and diversification of polymers that can be used for making such materials. The purpose of this invention is to provide an approach on selecting and using polypropylene composition for producing nonwoven fabric sheet comprising fibers having an improved and controllable crimp and a nonwoven fabric having higher loft as compared to these known products while maintaining other desirable properties.

The present inventors have conducted extensive studies, and as a result have found that the aforementioned properties can be achieved by using specific polypropylene composition. It was surprisingly found that with using polypropylene composition according to the present invention different tailor-made curvature of the fibers can be formed, which dominating the formation of crimps. With certain range of the curvature the softness of nonwoven fabric made from the fibers is optimised.

Accordingly, the present invention provides:

Use of polymer composition comprising a first propylene polymer A and a second propylene polymer B for producing crimped multicomponent fibers having a side by side cross-sectional configuration, wherein (i) the first propylene polymer A and second propylene polymer B are distributed over the cross section of the fiber in a side by side arrangement, (ii) the mass ratio of the first propylene polymer A and the second propylene polymer B [A:B] is in the range of 10:90 to 90:10, and (iii) the absolute value of the difference of the crystallization temperature [Tc (A)] of the propylene polymer (A) and the crystallization temperature [Tc (B)] of the propylene polymer (B) determined according to ISO11357 with a scan rate of 10° C./min is in the range of 6 to 30° C.

Said crimped multicomponent fiber having a side by side cross-sectional configuration is preferably characterized in that the interface line, contained in the radial plane of the fibers, between the two propylene polymers (A) and (B) is curved and its curvature (c), as defined by the quotient (h)/(b), is 0.05 to 0.25, wherein (b), the "baseline length", is the length of the imaginary straight baseline connecting the two endpoints of the curved interface line, and (h), the "bow height", is the distance of the crest of the curved interface line from the baseline.

The radial plane is perpendicular to the longitudinal direction of the fibers, and as such at a 90° angle to the longitudinal axis of the fiber at the given position. The shape of the radial interface line, which defines the preferred embodiment of present invention, is the shape of the interface line that is contained in this plane. This is to distinguish from the contour of the interface along a longitudinal or oblique line, which in a crimped fiber is naturally curved to some extent by geometrical relation. The curved nature of the radial interface line, which defines the present invention, is not geometrically related to the crimp of the fiber.

In preferred embodiments the curvature (c) of the radial interface line is between 0.08 to 0.22, preferably 0.10 to 0.20, more preferably 0.12 to 0.18. Very favourable crimping behaviour has been observed in many cases when the curvature is within these ranges.

In a preferred embodiment, the crimped multicomponent fibers produced by using polymer composition as defined in the present invention are spunbonded fibers, which form nonwoven fabric sheets, preferably spunbonded fabric sheets. The sheet can comprise the bicomponent fibers following the inventive definition, in addition to other fibers like linear monocomponent fibers, or consist of bicomponent fibers following the inventive definition. As in reality the millions of fibers forming for a nonwoven material are never always identical, the term consisting of must be understood in a sense that the requirement is fulfilled when the fibers are all the same by production and the vast majority of fibers, e.g. more than 80% of the fibers, preferably more than 90% of the fibers show the inventive characteristic.

Definitions

Unless defined otherwise, all technical and scientific terms used herein have the same meaning as commonly understood by one of ordinary skill in the art to which the invention pertains. Although, any methods and materials similar or equivalent to those described herein can be used in practice for testing of the present invention, the preferred materials and methods are described herein. In describing and claiming the present invention, the following terminology will be used in accordance with the definitions set out below.

Unless clearly indicated otherwise, use of the terms "a," "an," and the like refers to one or more. According to the present invention, the expression "propylene homopolymer" relates to a polypropylene that consists substantially, i.e. of at least 99.0 mol %, more preferably of at least 99.5 mol %, still more preferably of at least 99.8 mol %, like of at least 99.9 mol %, of propylene units. In another embodiment, only propylene units are detectable, i.e. only propylene has been polymerized. Thus the polypropylene homopolymer can contain a maximum of 1.0 wt % of a $C_2$ or $C_4$ to $C_{10}$ alpha olefin comonomer, preferably a maximum of 0.5 wt %, still more preferably of a maximum of 0.2 wt %, like of a maximum of 0.1 wt % of a $C_2$ or $C_4$ to $C_{10}$ alpha olefin comonomer.

Such comonomers can be selected for example from ethylene, 1-butene, 1-hexene and 1-octene. Preferably the comonomer if present is ethylene.

In another embodiment only propylene units are detectable, i.e. only propylene has been polymerized. In this case the amount of comonomer is 0.0 wt %.

A propylene/a-olefin random copolymer is a copolymer of propylene monomer units and comonomer units, preferably selected from ethylene and C4-C12 alpha-olefins, in which the comonomer units are distributed randomly over the polymeric chain. The propylene random copolymer can comprise comonomer units from one or more comonomers different in their amounts of carbon atoms. In the following amounts are given in mol % unless it is stated otherwise.

Typical for propylene homopolymers and propylene/a-olefin random copolymer is the presence of only one glass transition temperature.

DETAILED DESCRIPTION

The present invention relates to use of specific polymer composition comprising a first propylene polymer A and a second propylene polymer B for producing crimped multicomponent fiber having a side by side cross-sectional configuration. In the following the polymer composition, first propylene polymer A and second propylene polymer B are described in more detail.

It is essential that in the polymer composition according to the present invention, the mass ratio of the first propylene polymer A and the second propylene polymer B [A:B] is in the range of 10:90 to 90:10, preferably in the range of 20:80 to 80:20, more preferably in the range of 25:75 to 60:40, and the absolute value of the difference of the crystallization temperature [Tc (A)] of the propylene polymer (A) and the crystallization temperature [Tc (B)] of the propylene polymer (B) is in the range of 6 to 30° C., preferably in the range of 6 to 20° C., more preferably in the range of 7 to 15° C., like in the range of 7 to 14° C.

First Propylene Polymer A

The first propylene polymer (A) can be a propylene homopolymer or a propylene/a-olefin random copolymer.

In case the first propylene polymer (A) is a propylene/a-olefin random copolymer, the first propylene polymer (A) may comprise monomers copolymerizable with propylene, for example comonomers such as ethylene and/or C4 to C8 α-olefins, in particular ethylene and/or C4 to C6 α-olefins, e.g. 1-butene and/or 1-hexene. Preferably the first propylene polymer (A) according to this invention comprises, especially consists of, monomers copolymerizable with propylene from the group consisting of ethylene, 1-butene and 1-hexene. More specifically the first propylene polymer (A) of this invention comprises-apart from propylene-units derivable from ethylene and/or 1-butene. In a preferred embodiment, the first propylene polymer (A) comprises units derivable from ethylene and propylene only.

It is preferred that the melt flow rate ($MFR_2$, 230° C., 2.16 kg, ISO 1133) of the first propylene polymer (A) is in the range of 15 to 120 g/10 min, more preferably in the range of 15 to 60 g/10 min and even more preferably in the range of 15 to 40 g/10 min.

It is further preferred that the molecular weight distribution (Mw/Mn) of the first propylene polymer (A) is in the range of 2.5 to 10.0 (measured by size exclusion chromatography according to ISO 16014), preferably in the range of 3.5 to 8.5, more preferably in the range of 4.0 to 7.5. In a specific embodiment of this invention, the first propylene polymer (A) is preferably a crystalline propylene homopolymer. The term "crystalline" indicates that the propylene homopolymer has a rather high melting temperature. Accordingly throughout the invention the propylene homopolymer is regarded as crystalline unless otherwise indicated. In this embodiment, first propylene polymer (A) being a propylene homopolymer has preferably a melting temperature Tm measured by differential scanning calorimetry (DSC, ISO 11357-1 & -2) in the range of 150° C. to 164° C., preferably in the range of 155° C. to 162° C., and a crystallization temperature Tc (DSC, ISO 11357-1 & -2) in the range of 90° C. to 135° C., preferably in the range of 100° C. to 130° C., more preferably in the range of 105 to 125° C., and a comonomer content<1.0 wt %, preferably in the range of 0.1-0.7 wt %.

In another specific embodiment of this invention, the first propylene polymer (A) is preferably propylene/a-olefin random copolymer with a comonomer content in the range of 1.0-5.5 wt %, preferably in the range of 1.2-5.0 wt %, more preferably in the range of 1.5-4.2 wt %. In this embodiment, the first propylene polymer (A) being a propylene/a-olefin random copolymer has preferably a melting temperature Tm measured by differential scanning calorimetry (DSC, ISO 11357-1 & -2) in the range of 142° C. to 155° C., preferably in the range of 145° C. to 152° C., and a crystallization temperature Tc (DSC, ISO 11357-1 & -2) in the range of 80° C. to 125° C., preferably in the range of 85° C. to 122° C., more preferably in the range of 90 to 120° C.

In a further preferred embodiment, the first propylene polymer (A) being a propylene/a-olefin random copolymer has preferably a molecular weight distribution (Mw/Mn) in the range of 4.5 to 10.0 (measured by size exclusion chromatography according to ISO 16014), preferably in the range of 5.0 to 9.0, more preferably in the range of 5.5 to 8.5.

It is further preferred that the first propylene polymer (A) has preferably a xylene cold soluble content (XCS) in the range of 1.5 to 10.0 wt %, more preferably in the range of 1.5 to 8.0 wt %.

The amount of xylene cold solubles (XCS) additionally indicates that first propylene polymer (A) is preferably free of any elastomeric polymer component, like an ethylene propylene rubber. In other words, the first propylene polymer (A) shall be not a heterophasic polypropylene, i.e. a system consisting of a polypropylene matrix in which an elastomeric phase is dispersed. Such systems are featured by a rather high xylene cold soluble content.

Second Propylene Polymer B

The second propylene polymer (B) can be a propylene homopolymer or a propylene/a-olefin random copolymer.

In case the second propylene polymer (B) is a propylene/a-olefin random copolymer, the second propylene polymer (B) may comprise monomers copolymerizable with propylene, for example comonomers such as ethylene and/or C4 to C8 α-olefins, in particular ethylene and/or C4 to C6 α-olefins, e.g. 1-butene and/or 1-hexene. Preferably the second propylene polymer (B) according to this invention comprises, especially consists of, monomers copolymerizable with propylene from the group consisting of ethylene, 1-butene and 1-hexene. More specifically the second propylene polymer (B) of this invention comprises-apart from propylene-units derivable from ethylene and/or 1-butene. In a preferred embodiment, the second propylene polymer (B) comprises units derivable from ethylene and propylene only.

It is preferred that the melt flow rate ($MFR_2$, 230° C., 2.16 kg, ISO 1133) of the second propylene polymer (B) is in the range of 15 to 120 g/10 min, more preferably in the range of 15 to 60 g/10 min and even more preferably in the range of 15 to 40 g/10 min.

It is further preferred that the molecular weight distribution (Mw/Mn) of the second propylene polymer (B) is in the range of 2.5 to 10.0 (measured by size exclusion chromatography according to ISO 16014), preferably in the range of 3.5 to 8.5, more preferably in the range of 4.0 to 7.5.

In a specific embodiment of this invention, the second propylene polymer (B) is preferably a crystalline propylene homopolymer. The term "crystalline" indicates that the propylene homopolymer has a rather high melting temperature. Accordingly throughout the invention the propylene homopolymer is regarded as crystalline unless otherwise indicated. In this embodiment, second propylene polymer (B) being a propylene homopolymer has preferably a melting temperature Tm measured by differential scanning calorimetry (DSC, ISO 11357-1 & -2) in the range of 150° C. to 164° C., preferably in the range of 155° C. to 162° C., and a crystallization temperature Tc (DSC, ISO 11357-1 & -2) in the range of 90° C. to 135° C., preferably in the range of 100° C. to 130° C., more preferably in the range of 105 to 125° C., and a comonomer content<1.0 wt %, preferably in the range of 0.1-0.7 wt %.

In another specific embodiment of this invention, second propylene polymer (B) is preferably propylene/a-olefin random copolymer with a comonomer content in the range of 1.0-5.5 wt %, preferably in the range of 1.2-5.0 wt %, more preferably in the range of 1.5-4.2 wt %. In this embodiment, the second propylene polymer (B) being a propylene/a-olefin random copolymer has preferably a melting temperature Tm measured by differential scanning calorimetry (DSC, ISO 11357-1 & -2) in the range of 142° C. to 155° C., preferably in the range of 145° C. to 152° C., and a crystallization temperature Tc (DSC, ISO 11357-1 & -2) in the range of 80° C. to 125° C., preferably in the range of 85° C. to 120° C., more preferably in the range of 90 to 115° C.

In a further preferred embodiment, the second propylene polymer (B) being a propylene/a-olefin random copolymer has preferably a molecular weight distribution (Mw/Mn) in the range of 4.5 to 10.0 (measured by size exclusion chromatography according to ISO 16014), preferably in the range of 5.0 to 9.0, more preferably in the range of 5.5 to 8.5.

It is further preferred that the second propylene polymer (B) has preferably a xylene cold soluble content (XCS) in the range of 1.5 to 10.0 wt %, more preferably in the range of 1.5 to 8.0 wt %.

The amount of xylene cold solubles (XCS) additionally indicates that second propylene polymer (B) is preferably free of any elastomeric polymer component, like an ethylene propylene rubber. In other words, the first propylene polymer (A) shall be not a heterophasic polypropylene, i.e. a system consisting of a polypropylene matrix in which an elastomeric phase is dispersed. Such systems are featured by a rather high xylene cold soluble content.

The propylene polymers including the first propylene polymer (A) and the second propylene polymer (B) of the present invention fulfilling the above mentioned requirements may be produced by polymerization process known in the state of the art. Commercially available propylene polymers may be used, with examples including HG475FB manufactured and sold by Borealis Polyolefin.

Preferably the propylene polymers (A and B) according to this invention produced in the presence of (a) a Ziegler-Natta catalyst comprising compounds of a transition metal of Group 4 to 6 of IUPAC, a Group 2 metal compound and an internal donor, wherein said internal donor is a non-phthalic compound, more preferably a non-phthalic acid ester and still more preferably is a diester of non-phthalic dicarboxylic acids (b) optionally a co-catalyst, and (c) optionally an external donor.

Using a Ziegler-Natta catalyst with a non-phthalic compound as internal donor enables the production of polypropylene homopolymers fulfilling requirement e).

It is preferred that the internal donor is selected from optionally substituted malonates, maleates, succinates, glutarates, cyclohexene-1,2-dicarboxylates, benzoates and derivatives and/or mixtures thereof, preferably the internal donor is a citraconate.

Additionally or alternatively, the molar-ratio of co-catalyst to external donor (ED) [Co/ED] is 5 to 45.

In view of the above, it is preferred that the polypropylene polymer is free of phthalic compounds as well as their respective decomposition products, i.e. phthalic acid esters, typically used as internal donor of Ziegler-Natta catalysts (e.g. 4th generation Ziegler-Natta catalysts).

The term "free of" phthalic compounds in the meaning of the present invention refers to a polypropylene homopolymer in which no phthalic compounds as well as no respective decomposition products at all originating from the used catalyst, are detectable.

According to the present invention the term "phthalic compounds" refers to phthalic acid (CAS No. 88-99-3), its mono- and diesters with aliphatic, alicyclic and aromatic alcohols as well as phthalic anhydride.

As already indicated above, the polypropylene polymers of the present invention are optionally produced in a sequential polymerization process.

The term "sequential polymerization system" indicates that the polypropylene polymer is produced in at least two reactors connected in series. Accordingly, the polymerization system for sequential polymerization comprises at least a first polymerization reactor and a second polymerization reactor, and optionally a third polymerization reactor. The term "polymerization reactor" shall indicate that the main polymerization takes place. Thus, in case the process consists of two polymerization reactors, this definition does not exclude the option that the overall system comprises for instance a pre-polymerization step in a prepolymerization reactor. The term "consist of" is only a closing formulation in view of the main polymerization reactors. Preferably the first polymerization reactor is, in any case, a slurry reactor and can be any continuous or simple stirred batch tank reactor or loop reactor operating in bulk or slurry. Bulk means a polymerization in a reaction medium that comprises of at least 60% (w/w) monomer. According to the present invention the slurry reactor is preferably a (bulk) loop reactor.

The optional second polymerization reactor can be either a slurry reactor, as defined above, preferably a loop reactor or a gas phase reactor.

The optional third polymerization reactor is preferably a gas phase reactor.

Suitable sequential polymerization processes are known in the state of the art.

A preferred multistage process is a "loop-gas phase"-process, such as developed by Borealis (known as BORSTAR® technology) described e.g. in patent literature, such as in EP 0 887 379, WO 92/12182 WO 2004/000899, WO 2004/111095, WO 99/24478, WO 99/24479 or in WO 00/68315.

A further suitable slurry-gas phase process is the Spheripole process of Basell.

It is within the skill of art skilled persons to choose the polymerization conditions in a way to yield the desired properties of the polypropylene polymer.

Polymer Composition

In an especially preferred embodiment of the present invention, the first propylene polymer A and second propylene polymer B are different, and at least one of the propylene polymers (A and B) is visbroken.

Thus in this embodiment preferably the melt flow rate (230° C./2.16 kg, ISO 1133) of either propylene polymers (A or B) before visbreaking is much lower, like from 0.5 to 50 g/10 min. For example, the melt flow rate (230° C./2.16 kg) of either propylene polymer (A or B) before visbreaking is from 1.0 to 45 g/10 min, like from 1.5 to 40 g/10 min.

Preferably, the ratio of the MFR after visbreaking [MFR final] to the MFR before visbreaking [MFR start]

[MFR final]/[MFR start] is >5

Preferably the polypropylene polymer (A or B) has been visbroken with a visbreaking ratio [final MFR2 (230° C./2.16 kg)/start MFR2 (230° C./2.16 kg)] of greater than 5 to 50.

The "final $MFR_2$ (230° C./2.16 kg)" is the $MFR_2$ (230° C./2.16 kg) of the polypropylene polymer (A or B) after visbreaking and the "start $MFR_2$ (230° C./2.16 kg)" is the $MFR_2$ (230° C./2.16 kg) of the polypropylene polymer (A or B) before visbreaking.

More preferably, the polypropylene polymer (A or B) has been visbroken with a visbreaking ratio [final $MFR_2$ (230° C./2.16 kg)/start $MFR_2$ (230° C./2.16 kg)] of 8 to 25.

Even more preferably, polypropylene polymer (A or B) has been visbroken with a visbreaking ratio [final $MFR_2$ (230° C./2.16 kg)/start $MFR_2$ (230° C./2.16 kg)] of 10 to 20.

Preferred mixing devices suited for visbreaking are known to an art skilled person and can be selected i.a. from discontinuous and continuous kneaders, twin screw extruders and single screw extruders with special mixing sections and co-kneaders and the like.

The visbreaking step according to the present invention is performed either with a peroxide or mixture of peroxides or with a hydroxylamine ester or a mercaptane compound as source of free radicals (visbreaking agent) or by purely thermal degradation.

Typical peroxides being suitable as visbreaking agents are 2,5-dimethyl-2,5-bis(tert.butylperoxy) hexane (DHBP) (for instance sold under the tradenames Luperox 101 and Trigonox 101), 2,5-dimethyl-2,5-bis(tert.butyl-peroxy) hexyne-3 (DYBP) (for instance sold under the tradenames Luperox 130 and Trigonox 145), dicumyl-peroxide (DCUP) (for instance sold under the tradenames Luperox DC and Perkadox BC), di-tert.butyl-peroxide (DTBP) (for instance sold under the tradenames Trigonox B and Luperox Di), tert-.butyl-cumyl-peroxide (BCUP) (for instance sold under the tradenames Trigonox T and Luperox 801) and bis(tert-.butylperoxy-isopropyl)benzene (DIPP) (for instance sold under the tradenames Perkadox 14S and Luperox DC).

Suitable amounts of peroxide to be employed in accordance with the present invention are in principle known to the skilled person and can easily be calculated on the basis of the amount of propylene homopolymer to be subjected to visbreaking, the $MFR_2$ (230° C.) value of the propylene homopolymer to be subjected to visbreaking and the desired target $MFR_2$ (230° C.) of the product to be obtained.

Accordingly, typical amounts of peroxide visbreaking agent are from 0.005 to 0.5 wt %, more preferably from 0.01 to 0.2 wt %, based on the total amount of polypropylene polymer (A or B) employed. Typically, visbreaking in accordance with the present invention is carried out in an extruder, so that under the suitable conditions, an increase of melt flow rate is obtained. During visbreaking, higher molar mass chains of the starting product are broken statistically more frequently than lower molar mass molecules, resulting as indicated above in an overall decrease of the average molecular weight and an increase in melt flow rate.

After visbreaking the polypropylene polymer (A or B) according to this invention is preferably in the form of pellets or granules. The instant polypropylene polymer (A or B) is preferably used in pellet or granule form for the spunbonded fiber process.

In one specific embodiment of the present invention, only one of the propylene polymers (A and B) is visbroken, and the absolute value of the difference of $M_z/M_w$ between propylene polymer A and B is from 0.3 to 10.0, preferably from 0.5 to 8.5, more preferably from 1.0 to 5.5, even more preferably from 1.5 to 4.0.

In another embodiment of the present invention, both of the Propylene polymers (A and B) are visbroken, and the absolute value of the difference of $M_z/M_w$ between propylene polymer A and B is between 0.0 to 0.3, preferably between 0.00 to 0.25, more preferably between 0.00 to 0.22, even more preferably between 0.00 to 0.15.

In a further preferred embodiment of the present invention, at least one of the propylene polymers A and B is nucleated, and the amount of nucleating agent is in the range of 0.01-5000 ppm, preferably in the range of 0.05-4500 ppm, more preferably 0.1-4000 ppm, like 0.15-3000 ppm based on the total amount of the nucleated propylene polymer.

In case the propylene polymer A or B is nucleated, it may comprise a nucleating agent, preferably a α-nucleating agent. The α-nucleating agent is preferably selected from the group consisting of (i) salts of monocarboxylic acids and polycarboxylic acids, e.g. sodium benzoate or aluminum tert-butylbenzoate, and (ii) dibenzylidenesorbitol (e.g. 1,3:2,4 dibenzylidenesorbitol) and C1-C8-alkyl-substituted dibenzylidenesorbitol derivatives, such as methyldibenzylidenesorbitol, ethyldibenzylidenesorbitol or dimethyldibenzylidenesorbitol (e.g. 1,3:2,4 di(methylbenzylidene) sorbitol), or substituted nonitol-derivatives, such as 1,2,3-trideoxy-4,6:5,7-bis-O-[(4-propylphenyl)methylene]-nonitol, and (iii) salts of diesters of phosphoric acid, e.g. sodium 2,2'-methylenebis(4,6-di-tert-butylphenyl) phosphate or aluminium-hydroxy-bis [2,2'-methylene-bis(4,6-di-t-butylphenyl)phosphate], and (iv) vinylcycloalkane polymer and vinylalkane polymer (as discussed in more detail below), and (v) mixtures thereof.

Such additives are generally commercially available and are described, for example, in "Plastic Additives Handbook", pages 871 to 873, 5th edition, 2001 of Hans Zweifel.

Preferably the propylene polymer A or B, contains up to 5.0 wt.-% of the α-nucleating agent. In a preferred embodiment, the propylene homopolymer contains 0.01 to 5000 ppm, preferably 0.05-4500 ppm, more preferably 0.1-4000 ppm, most preferably 0.15-3000 ppm of a α-nucleating agent, in particular selected from the group consisting of dibenzylidenesorbitol (e.g. 1,3:2,4 dibenzylidene sorbitol), dibenzylidenesorbitol derivative, preferably dimethyldibenzylidenesorbitol (e.g. 1,3:2,4 di(methylbenzylidene) sorbitol), or substituted nonitol-derivatives, such as 1,2,3-trideoxy-4,6:5,7-bis-O-[(4-propylphenyl)methylene]-nonitol, sodium 2,2'-methylenebis(4,6-di-tert-butylphenyl) phosphate, vinylcycloalkane polymer, vinylalkane polymer, and mixtures thereof.

In an especial preferred embodiment of the present invention, the first propylene polymer A is a propylene homopolymer, and the second propylene polymer B is a propylene random copolymer. In this case, the amount of first propylene polymer A is preferably less than the amount of second propylene polymer B. More preferably the mass ratio of the first propylene polymer A, like the propylene homopolymer, and the second propylene polymer B, like the propylene/α-olefin random copolymer [A:B] is in the range of 10:90 to 50:50, preferably in the range of 20:80 to 45:55, more preferably in the range of 25:85 to 45:55.

The use of polymer composition of the present invention as defined above is for producing crimped multicomponent fiber having a side by side cross-sectional configuration. Preferably the multicomponent fibers are bicomponent fibers consisting of the first and second components. In the use of present invention, the first and second components are arranged in a side-by-side arrangement. The term "side-by-side" arrangements includes variants such as, for example, hollow side-by-side arrangements, eccentric hollow side-by-side arrangements and side-by-side multilobal arrangements.

The crimped bicomponent fibers are typically helically crimped. In one embodiment the average crimp number of the crimped multicomponent fibers is in the range of at least 7 and preferably at least 10 crimps per cm in the fiber, as measured as per Japanese standard JIS L-1015-1981 under a pretension load of 2 mg/denier. The crimp amplitude is preferably in the range of below 0.30 mm and preferably between 0.20 and 0.30 mm when measured according to JIS L-1015-1981 under a pre-tension load of 2 mg/denier.

The fibers preferably have a linear mass density in the range of between 1.0 to 2.2 denier, preferably 1.2 to 2.0 denier.

The basis weight of each of the spunbonded layers within the multilayer sheet may be between 4-40 g/m$^2$, preferably between 5-25 g/m$^2$.

The density of the nonwoven fabric sheet is preferably less than 60 mg/cm$^3$ and preferably less than 50 mg/cm$^3$, which are values that are typical for high loft nonwovens with crimped fibers. Standard loft nonwovens with uncrimped fibers, as a comparison, typically have densities higher than 60-70 mg/cm$^3$.

The thickness of the nonwoven fabric sheet is preferably greater than 0.35 mm, more preferably greater than 0.37 mm, for basis weights of 20 g/m$^2$ or more, when measured according to WSP.120.6, option A, pressure of 0.5 kPa on a 2500 mm$^2$ plate.

The method and process of production of crimped multicomponent fiber having a side by side cross sectional configuration in the form of spunbonded nonwoven fabric sheet using polymer composition of the present invention is defined below:

The spunbonded nonwoven fabric sheet is made in an apparatus comprising at least two extruders with a spinnerette, a drawing channel and a moving belt, wherein the fibers are spun in a spinnerette, drawn in a drawing channel and laid down on a moving belt, wherein the apparatus comprises a pressurized process air cabin from which process air is directed through the drawing channel to draw fibers.

The drawing channel may comprise more than one section. The drawing channel or a section of the drawing channel may get narrower with increasing distance from the spinnerette. It one embodiment the converging angle can be adjusted. The apparatus may form a closed aggregate extending between at least the point of process air entry until the end of the drawing channel, so no air can enter from the outside and no process air supplied can escape to the outside. In one embodiment the apparatus comprises at least one diffuser, which is arranged between the end of the drawing channel and the moving belt.

The pressure difference between the ambient pressure and the pressure in the process air cabin is usually higher than 2000 Pascal. It has been observed that, within reasonable overall ranges, higher cabin pressures tend to lead to curvatures in the desired ranges and have a positive influence on crimp. In preferred embodiments, the cabin pressure is hence higher than 2500 Pascal, more preferably higher than 3000 Pascal or even higher than 3500 Pascal. For process stability, on the upper end, the cabin pressures preferably are less than 6000 Pascal and preferably less than 5000 Pascal.

Suitable process air temperatures are usually greater than 10° C. It has been observed, however, that, within reasonable overall ranges, higher process air temperatures tend to lead to curvatures in the desired ranges and have a positive influence on crimp. In preferred embodiments, the process air temperature is hence higher than 20° C., more preferably higher than 25° C. On the upper end, the process air temperatures are preferably below 60° C. If process air of two different temperatures is applied to the fibers during drawing, the above description relates to the process temperature of the air contacting the filaments first.

The maximum air speed in the drawing channel is usually higher than 50 m/s.

Figure 2:
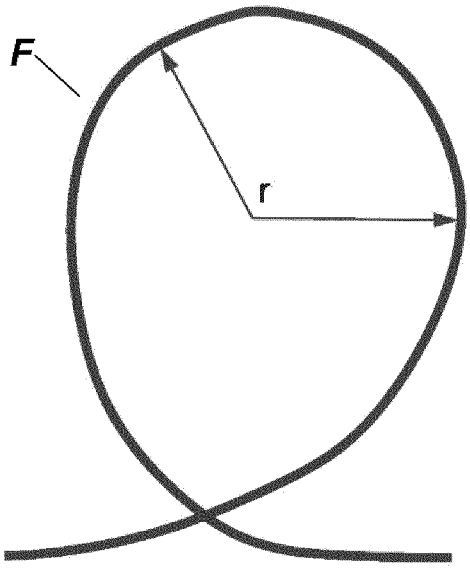
Figure 3:
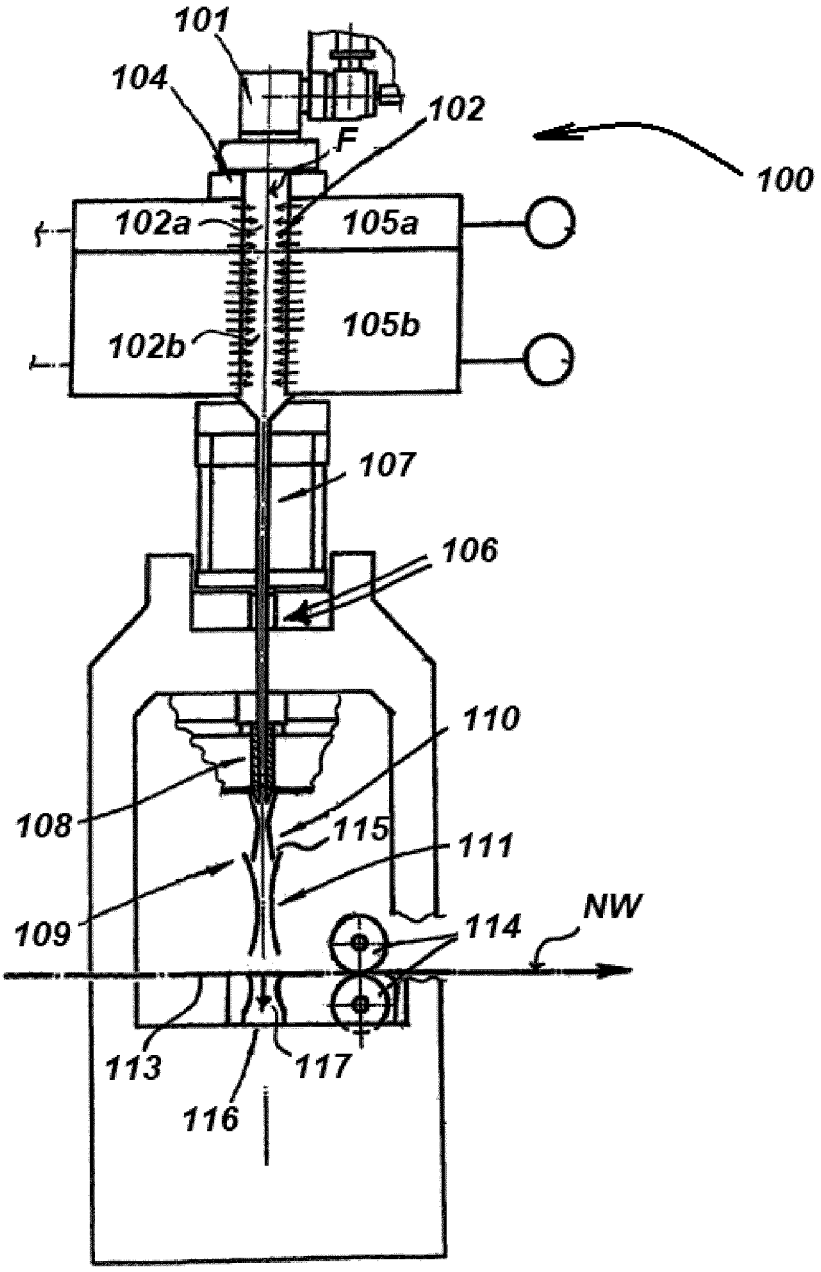
Figure 4:
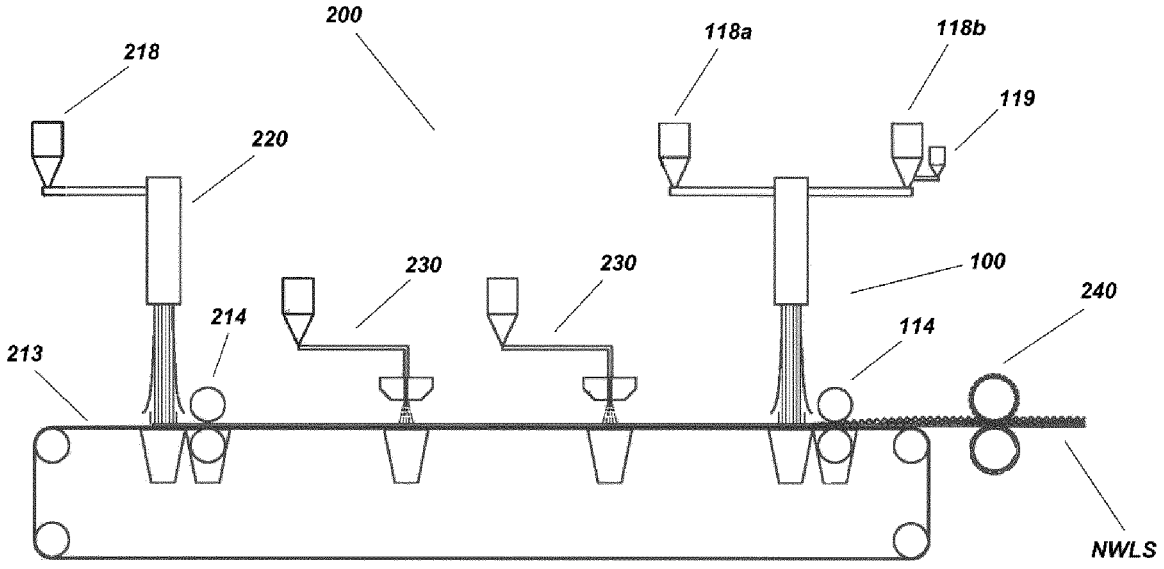
Figure 5:
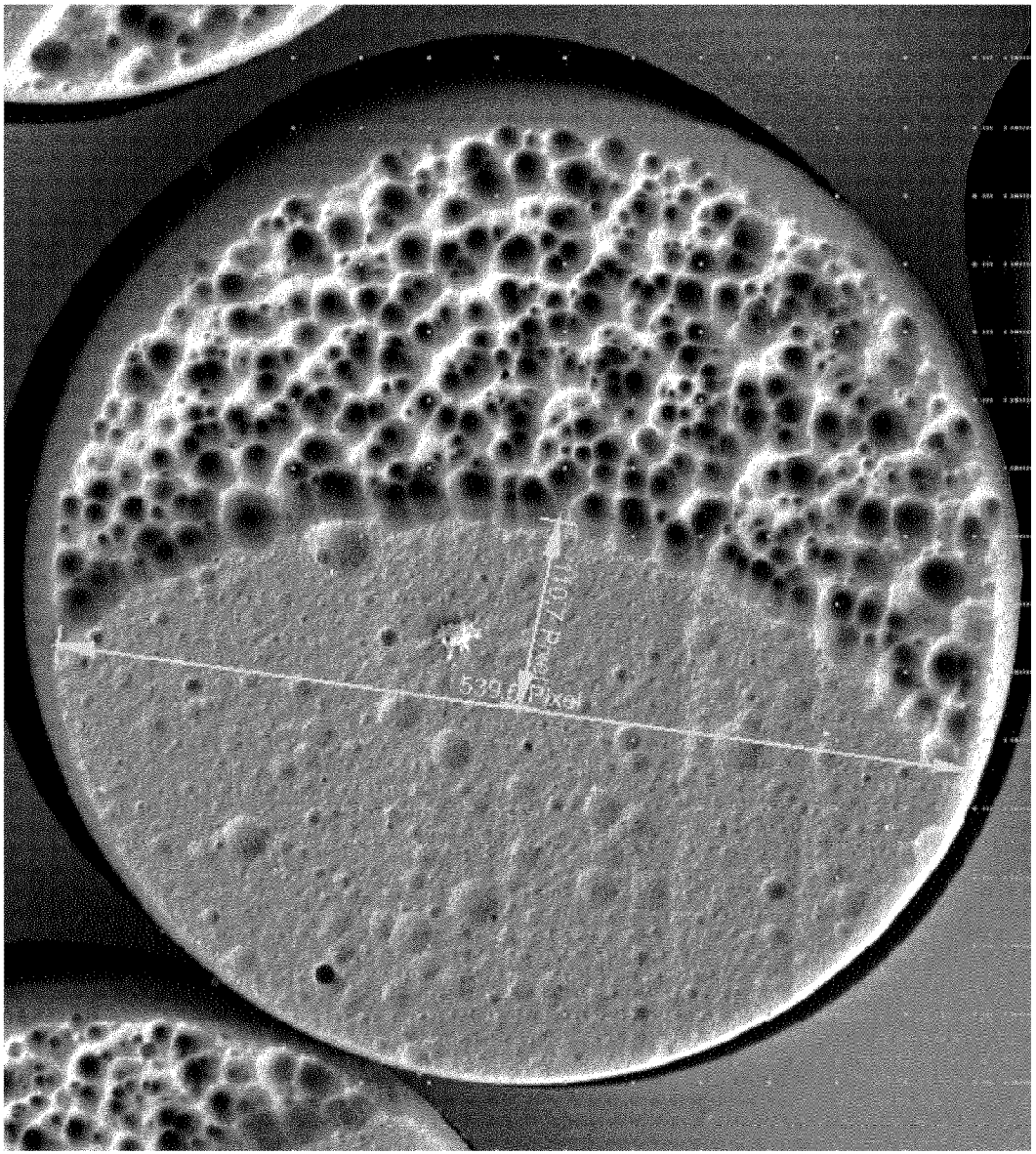

Further details and advantages of the invention will become apparent from the figures and examples described in the following. The figures show:

FIG. 1: a schematic cross-section of a generic side-by-side bicomponent fiber without curvature;

FIG. 2: a schematic illustration of a crimped fiber;

FIG. 3: a schematic illustration of a spinning machine suitable for producing spunbonded nonwoven fabric sheets according to the invention;

FIG. 4: a schematic illustration of a production line suitable for producing multilayer sheets according to the invention;

FIG. 5: a SEM (Scanning Electron Microscope) picture of a cross-section of a side-by-side bicomponent fiber having a curved interface line;

FIG. 1 shows schematic illustration of a cross-section of a side-by-side bicomponent fiber. The fiber F comprise first and second propylene polymer A and B arranged side-by-side. The arrangement extends over the entire length of the fiber.

FIG. 2 is a schematic illustration of a section of a crimped fiber F as comprised in a nonwoven fabric sheet of the invention. The fiber is curved and comprises a certain crimp radius and a certain crimp count.

FIG. 3 shows a spinning machine 100 that is suitable for producing spunbonded nonwovens according to the invention. Spunbonded nonwovens NW are produced from continuous fibers F of thermoplastic material, which are spun in a spinnerette 101 and subsequently passed through a cooling device 102. A monomer suctioning device 104 to remove gases in the form of decomposition products, monomers, oligomers and the like generated during the spinning of the fibers F is arranged between the spinnerette 101 and the cooling device 102. The monomer extraction device 4 comprises suction openings or suction gaps.

In the cooling device 102, process air is applied to the fiber curtain from the spinnerette 101 from opposite sides. The cooling device 102 is divided into two sections 102*a* and 102*b*, which are arranged in series along the flow direction of the fibers. Thus, process air of a relatively higher temperature (for example 60° C.) can be applied to the fibers at an earlier stage in chamber section 102*a* and process air of a relatively lower temperature (for example 30° C.) can be applied to the fibers at a later stage in chamber section 102*b*. The supply of process air takes place via air supply chambers 105*a* and 105*b*, respectively. The cabin pressure within chambers 105*a* and 105*b* can be the same and can, for example, be about 3000 Pascal above ambient pressure, for example.

A drawing device 106 to draw and stretch the fibers 103 is arranged below the cooling device 102. The drawing device includes an intermediate channel 107, which preferably converges and gets narrower with increasing distance from the spinnerette 101. It one embodiment the converging angle of the intermediate channel 107 can be adjusted. After the intermediate channel 107 the fiber curtain enters the lower channel 108.

The cooling device 102 and the drawing device 106, including intermediate channel 107 and lower channel 108, are together formed as a closed aggregate, meaning that over the entire length of the aggregate, no major air flow can enter from the outside and no major process air supplied in the cooling device 102 can escape to the out-side. Some fume extraction devices directly under the spinneret extracting a minor air volume can be incorporated.

The fibers 103 leaving the drawing device 106 are then passed through a laying unit 109, which comprises two successively arranged diffusers 110 and 111 are provided, with diffuser 110 having a divergent section and diffuser 111 having a convergent section and an adjoining divergent section. The diffuser angles, in particular the diffuser angles in the divergent regions of the diffusers 110 and 111, are adjustable. Between the diffusers 110 and 111 is a gap 115 through which ambient air is sucked into the fiber flow space.

After passing through the laying unit 109, the fibers F are deposited as nonwoven web NW on a spinbelt 113, formed from an air-permeable web. A suctioning device 116 is arranged below the laydown area of the spinbelt 113 so suck off process air, which is illustrated in FIG. 3 by the arrow 117.

Once deposited the nonwoven web NW is first guided through the gap between a pair of pre-consolidation rollers 114 for pre-consolidating the nonwoven web NW.

FIG. 4 illustrates a production line 200 for producing SMS-type nonwoven laminate fabric sheets NWLS of the present invention.

Specifically, the machine is configured for producing an SMS-type nonwoven laminate fabric sheet NWLS in the form of, specifically, an SMMSH sheet, where "S" stands for a regular spunbonded layer, i.e. a layer formed from uncrimped fibers, "M" stands for a meltblown layer, and "SH" stands for a high loft spunbonded layer formed from crimped bicomponent fibers. The layer "SH" within this fabric is the layer that is according to the invention. An SMS-type sheet where the spunbonded structure on one side of the internal meltblown structure is high loft and the spunbonded structure on one side of the internal meltblown structure is a regular spunbonded sheet are known as semi-high-loft structures. The regular S layer provides mechanical stability, the M layer improves liquid barrier properties, and the loft S layer enhances softness and flexibility of the fabric.

The production line 200 comprises a spinning machine 100 for producing the SH-layer, which is configured as illustrated in FIG. 3. The two reservoirs 118*a* and 118*b* contain the two different polymer components A and B used for spinning the bicomponent fibers. An annex reservoir 119 may contain a masterbatch with an additive such as a nucleating agent or a visbreaking additive.

Further, the production line 200 comprises a spinbelt 213, a first spinning machine 220, comprising only one polymer reservoir 218 and configured for spinning monocomponent fibers, for forming the regular S layer, two meltblowing machines 230 for forming the MM double layer meltblown structure. The machines 220, 230 and 100 are serially arranged along the spinbelt 213.

Downstream each spinning machine 220 and 100 a pair of pre-consolidation rollers 214 and 114 is arranged. A calender/embossing roll 240 for firmly bonding the layers of the laminate sheet NWLS is arranged downstream the last spinning machine.

FIG. 5 shows an SEM picture (Scanning Electron Microscope) of a cross-section of a bicomponent fiber having a curved interface line between the polymer components.

The picture of FIG. 5 was taken by the method explained in the following, which is generally a good method to measure the curvature that defines the present invention. The curvature, in principle, is an absolute geometrical property of the fibers and not dependent on how it is measured. There are naturally some variations of curvature within a single fiber over its length, and not every fiber in the fabric sheet is the same. For practical purposes, it is most preferred that at least ten fibers are picked from a nonwoven sheet, the curvature of each of the picked fiber measured at a randomly selected length position, and the average number used.

When measured from a nonwoven sheet, firstly the machine direction is identified and the sheet encapsulated and demobilized in a polyester or epoxy resin. The resulting polymer block is then cut in a cross-machine directional plane that is perpendicular to the plane of the encapsulated nonwoven sheet. The cut surface is polished to have a visible interface after etching. The cross-sectional surface of the fibers exposed at the polished cut surface are etched to etch away the more amorphous of the polymer components. Fiber ends having the most circular cross sections and hence being oriented in machine direction as strictly as possible at the cut surface are selected for measurement. Small direction deviations can be corrected for distortion. In practical terms, a useful fiber-cross-section is an ellipse with a ratio between the major and minor axis below 1.2. Preferred is that the fibers show up as circle. After the SEM pictures are taken in a manner generally known to practitioners, picture based measurement systems like DatInf measure from DatInf GmbH can be used to determine curvature.

It can be seen that the interface between the two polymers is curved. In this example of FIG. 5, the polymer on the left hand side was a propylene-α-olefin copolymer with a relatively lower crystallization temperature and the polymer on the right hand side was a propylene homopolymer with a relatively higher crystallization temperature. The curved interface is arched toward the left side, i.e. arched toward the propylene-α-olefin copolymer with a relatively lower crystallization temperature. The polymer component with the higher crystallization temperature has the more compact cross-section.

The curvature "c" is measured and calculated according to the following description. First the distance "b" between the polymer surface intersections is measured with a line drawn between the polymer intersections of the fiber surfaces. This line is the imaginary baseline. It is 540 pixels in the given example. Next the bow height "h" is measured by drawing a line orthogonally from the baseline (usually the middle of the baseline) to the crest of the curved interface line. The length of the line corresponds to the bow height "h" and, in the given example, is 111 pixels.

The curvature is then given by 111/540=0.206. FIG. 5 hence shows a fiber having a curvature within the range required by the invention.

The invention will now be described with reference to the following non-limiting examples.

Experimental Part

A) Methods

The following definitions of terms and determination methods apply for the above general description of the invention as well as to the below examples unless otherwise defined. $MFR_2$ (230° C.) was measured according to ISO 1133 (230° C., 2.16 kg load). The $MFR_2$ of the polypropylene composition is determined on the granules of the material, while the $MFR_2$ of the melt-blown web is determined on cut pieces of a compression-molded plaque prepared from the web in a heated press at a temperature of not more than 200° C., said pieces having a dimension which is comparable to the granule dimension.

The xylene soluble fraction at room temperature (xylene cold soluble XCS, wt %): The amount of the polymer soluble in xylene is determined at 25° C. according to ISO 16152; 5$^{th}$ edition; 2005 Jul. 1.

DSC analysis, melting temperature ($T_m$), melting enthalpy ($H_m$), crystallization temperature ($T_c$) and crystallization enthalpy ($H_c$): measured with a TA Instrument Q200 differential scanning calorimetry (DSC) on 5 to 7 mg samples. DSC is run according to ISO 11357-1, -2 and -3/method C2 in a heat/cool/heat cycle with a scan rate of 10° C./min in the temperature range of −30 to +225° C. Crystallization temperature ($T_c$) and crystallization enthalpy ($H_c$) are determined from the cooling step, while melting temperature ($T_m$) and melting enthalpy ($H_m$) are determined from the second heating step respectively from the first heating step in case of the webs.

Number average molecular weight (Mn), weight average molecular weight (Mw), Z-average molecular weight (Mz), and MWD (Mw/Mn) of polypropylene were determined by Gel Permeation Chromatography (GPC) according to ISO 16014-4:2003 and ASTM D 6474-99. A PolymerChar GPC instrument, equipped with infrared (IR) detector was used with 3× Olexis and 1× Olexis Guard columns from Polymer Laboratories and 1,2,4-trichlorobenzene (TCB, stabilized with 250 mg/L 2,6-Di tert butyl-4-methyl-phenol) as solvent at 160° C. and at a constant flow rate of 1 mL/min. 200 μL of sample solution were injected per analysis. The column set was calibrated using universal calibration (according to ISO 16014-2:2003) with at least 15 narrow MWD polystyrene (PS) standards in the range of 0.5 kg/mol to 11 500 kg/mol. Mark Houwink constants for PS, PE and PP used are as described per ASTM D 6474-99. All samples were prepared by dissolving the polymer sample to achieve concentration of ~1 mg/ml (at 160° C.) in stabilized TCB (same as mobile phase) for 2.5 hours for PP at max. 160° C. under continuous gently shaking in the autosampler of the GPC instrument. The MWD of the polypropylene composition is determined on the granules of the material, while the MWD of the melt-blown web is determined on a fiber sample from the web, both being dissolved in an analogous way.

Grammage and Thickness of the Web

The unit weight (grammage) of the webs in g/m$^2$ was determined in accordance with ISO 536:1995. The Thickness of the webs was measured in webs with a grammage of 20 g/m$^2$.

Curvature (c) of the Crimped Fibers

Curvature (c) of the fibers was determined by the method as specified above in connection with FIG. 5

Filament Fineness

The filament fineness in denier has been calculated from the average fibre diameter by using the following correlation:

$$\text{Fibre diameter (in cm)}=(4.444\times10\text{-}6\times\text{denier}/0.91\times\pi)^{1/2}$$

B) Examples

The preparation of propylene polymers (PP1-PP4) used in inventive examples (IE1-6) and the comparative Examples (CE1-2) were described in details below.

Base polymers: the base polymers were produced as follows:

- PP1: The production of base polymer of PP1 is described in WO2017118612 as the polypropylene homopolymer used for inventive examples.
- PP2: base polymer of PP2 was prepared by compounding 95 wt % of PP1 base polymer with 5 wt % of PP-MB (described as IE2 in EP3184587B1).
- PP3: The catalyst used in the polymerization process of base polymer of PP3 was prepared as follows:

Used Chemicals:

- 20% solution in toluene of butyl ethyl magnesium (Mg(Bu)(Et), BEM), provided by Chemtura 2-ethylhexanol, provided by Amphochem
- 3-Butoxy-2-propanol-(DOWANOL™ PnB), provided by Dow
- bis(2-ethylhexyl) citraconate, provided by SynphaBase
- $TiCl_4$, provided by Millenium Chemicals
- Toluene, provided by Aspokem
- Viscoplex® 1-254, provided by Evonik
- Heptane, provided by Chevron Preparation of a Mg Alkoxy Compound Mg alkoxide solution was prepared by adding, with stirring (70 rpm), into 11 kg of a 20 wt-% solution in toluene of butyl ethyl magnesium (Mg(Bu)(Et)), a mixture of 4.7 kg of 2-ethylhexanol and 1.2 kg of butoxypropanol in a 20 l stainless steel reactor. During the addition the reactor contents were maintained below 45° C. After addition was completed, mixing (70 rpm) of the reaction mixture was continued at 60° C. for 30 minutes. After cooling to room temperature 2.3 kg g of the donor bis(2-ethylhexyl) citraconate was added to the Mg-alkoxide solution keeping temperature below 25° C. Mixing was continued for 15 minutes under stirring (70 rpm).

Preparation of Solid Catalyst Component 20.3 kg of $TiCl_4$ and 1.1 kg of toluene were added into a 20 l stainless steel reactor. Under 350 rpm mixing and keeping the temperature at 0° C., 14.5 kg of the Mg alkoxy compound prepared in example 1 was added during 1.5 hours. 1.7 l of Viscoplex® 1-254 and 7.5 kg of heptane were added and after 1 hour mixing at 0° C. the temperature of the formed emulsion was raised to 90° C. within 1 hour. After 30 minutes mixing was stopped catalyst droplets were solidified and the formed catalyst particles were allowed to settle. After settling (1 hour), the supernatant liquid was siphoned away. Then the catalyst particles were washed with 45 kg of toluene at 90° C. for 20 minutes followed by two heptane washes (30 kg, 15 min). During the first heptane wash the temperature was decreased to 50° C. and during the second wash to room temperature.

The thus obtained catalyst was used along with triethylaluminium (TEAL) as co-catalyst and dicyclopentyl dimethoxy silane donor (D-donor) as external donor.

Polymerizations were performed in a Borstar PP-type polypropylene (PP) pilot plant, comprising one loop reactor and one gas phase reactor.

polymerization conditions for PP3 base polymer are described in Table 1.

TABLE 1

Preparation of the base propylene polymers PP3

| | | PP3 base |
|---|---|---|
| Prepolymerization | | |
| TEAL | [g/tC3] | 150 |
| Donor | [g/tC3] | 40 |
| Temperature | [° C.] | 30 |
| res. time | [h] | 0.3 |
| Donor | [—] | D |
| Loop | | |
| Temperature | [° C.] | 70 |
| Split | [%] | 44 |
| H2/C3 ratio | [mol/kmol] | 0.5 |
| C2/C3 ratio | [mol/kmol] | 4.8 |
| $MFR_2$ | [g/10 min] | 2.7 |
| XCS | [wt.-%] | 5 |
| GPR 1 | | |
| Temperature | [° C.] | 80 |
| Pressure | [kPa] | 2000 |
| Split | [%] | 56 |
| H2/C3 ratio | [mol/kmol] | 6.4 |
| C2/C3 ratio | [mol/kmol] | 11.6 |

The base polymer of PP3 has been visbroken together with 5 wt % of PP-MB, 500 ppm of Irganox 3114 (BASF), 500 ppm of Irgafos 168 (BASF), 500 ppm of Ceasit FI (Baerlocher) by a co-rotating twin-screw extruder at 200-230° C. using an appropriate amount of (tert.butylperoxy)-2,5-dimethylhexane (Trigonox 101, distributed by Akzo Nobel, Netherlands).

PP4: The production of base polymer of PP4 is described in EP2999721B2 as inventive example IE3.

TABLE 2 properties of polypropylene polymers for inventive and comparative examples measured after visbreaking on pellets

| | | PP1 | PP2 | PP3 | PP4 |
|---|---|---|---|---|---|
| C2 content | [wt.-%] | 0.4 | 0.4 | 2.1 | 3.6 |
| MFR final | [g/10 min] | 27 | 27 | 27 | 33 |
| Mw/Mn | [—] | 4.7 | 4.7 | 4.6 | 6.4 |
| Mz/Mw | [—] | 2.07 | 2.08 | 2.06 | 2.7 |
| XCS | [wt.-%] | 4.5 | 4.4 | 3.4 | 8.1 |
| Tg | [° C.] | −0.5 | −0.5 | −2.1 | −4.7 |
| Tm | [° C.] | 158 | 163 | 154 | 149 |
| Tc | [° C.] | 111 | 124 | 119 | 120 |

Preparation of Crimped Multicomponent Fiber Having a Side by Side Cross-Sectional Configuration A series of options with two polymers in a side-by-side configuration was processed on a machine as illustrated in FIG. 3.

For all options, a basis weight of 20 g/m$^2$ for the spunbonded nonwoven material sheet was used. Specific polymer throughput in the spinnerette 101 was approximately 0.52 g polymer per hole per minute. The cabin pressure was kept mostly constant at 4000 Pascal. Other process settings were kept in a normal range for the production of crimped fibers. For instance, the ceramic pre-consolidation rollers 114 on the spinbelt at the outlet side of the beam were run with a temperature of 50-70° C. The calender (not shown in FIG. 3, but positioned downstream the pre-consolidation rollers 114) was a standard open dot calender with 12% bonding area and 25 circular bonding points per cm$^2$. The temperature of the calender was in the range of 135-145° C.

Table 3 summarizes data regarding polymer composition used in the fiber preparation process, bow height of the cross-section of the fiber and thickness of the fabric made from the fibers with respect to inventive examples IE1, IE2, IE3, IE4, IE5 and IE6 and CE1 to CE2.

TABLE 3

| Examples | Polymer A | Polymer B | [A:B] | $\Delta T_c$ [° C.] | ΔMz/Mw | Curvature (c) | Thickness of web@ 20 gsm [mm] |
|---|---|---|---|---|---|---|---|
| CE1 | PP2 | PP4 | 40:60 | 4 | 0.62 | 0.031 | 0.33 |
| CE2 | PP2 | PP3 | 40:60 | 5 | 0.02 | 0.278 | 0.36 |
| IE1 | PP1 | PP2 | 60:40 | 13 | 0.01 | 0.114 | 0.46 |
| IE2 | PP1 | PP2 | 30:70 | 13 | 0.01 | 0.129 | 0.54 |
| IE3 | PP1 | PP3 | 50:50 | 8 | 0.01 | 0.116 | 0.57 |
| IE4 | PP1 | PP2 | 40:60 | 13 | 0.01 | 0.171 | 0.58 |
| IE5 | PP1 | PP4 | 40:60 | 9 | 0.63 | 0.134 | 0.63 |
| IE6 | PP1 | PP2 | 30:70 | 13 | 0.01 | 0.120 | 0.70 |

As can be seen, in order to get higher thickness of webs, the polymers in both sides need to have the right combination. As can be seen from table 3 webs of IE1 to IE6 have much higher thickness than the webs of CE1 and 2, while the grammage of the webs are the same (20 g/m2).

The invention claimed is:

1. A process for producing crimped multicomponent fibers having a side-by-side cross-sectional configuration, the process comprising:

providing a polymer composition comprising a first propylene polymer A and a second propylene polymer B; and forming the crimped multicomponent fibers having the side-by-side cross-sectional configuration from the polymer composition, wherein (i) the first propylene polymer A and second propylene polymer B are distributed over the cross section of a fiber in a side-by-side arrangement, (ii) a mass ratio of the first propylene polymer A and the second propylene polymer B [A:B] is in the range of 10:90 to 90:10, (iii) an absolute value of the difference of the crystallization temperature [Tc (A)] of the first propylene polymer A and the crystallization temperature [Tc (B)] of the second propylene polymer B determined according to ISO11357 with a scan rate of 10° C./min is in the range of 6 to 30° C., and an interface line, contained in a radial plane of the fibers, between the two propylene polymers (A) and (B) is curved and its curvature (c) is $$c = \frac{h}{b} = 0.05 \text{ to } 0.25$$

wherein the baseline length (b) is the length of an imaginary straight baseline connecting two endpoints of a curved interface line, and the bow height (h) is a distance of a crest of the curved interface line from a baseline.

2. The process according to claim 1, wherein the interface line, contained in the radial plane of the fibers, between the two propylene polymers (A) and (B) is curved and its curvature (c) is $$c = \frac{h}{b} = 0.10 \text{ to } 0.20$$

wherein the baseline length (b) is the length of the imaginary straight baseline connecting the two endpoints of the curved interface line, and the bow height (h) is the distance of the crest of the curved interface line from the baseline.

3. The process according to claim 1, wherein the first propylene polymer A is a propylene homopolymer or a propylene/α-olefin random copolymer, the first propylene polymer A having a melt flow rate (MFR, 230° C., 2.16 kg, ISO 1133) of 15 to 120 g/10 min, and/or having a molecular weight distribution (Mw/Mn) in the range of 2.5 to 10.0 (measured by size exclusion chromatography according to ISO 16014).

4. The process according to claim 1, wherein the first propylene polymer A has (i) a melting temperature $T_m$ (DSC, ISO 11357-1 &-2) in the range of 150° C. to 164° C., (ii) a crystallization temperature $T_c$ (DSC, ISO 11357-1 &-2) in the range of 90° C. to 135° C., and (iii) a comonomer content<1.0 wt %.

5. The process according to claim 1, wherein the first propylene polymer A has (i) a melting temperature $T_m$ (DSC, ISO 11357-1 &-2) in the range of 142° C. to 155° C., (ii) a crystallization temperature $T_c$ (DSC, ISO 11357-1 &-2) in the range of 80° C. to 125° C., and (iii) a comonomer content in the range of 1.0-5.5 wt %.

6. The process according to claim 1, wherein the second propylene polymer B is a propylene homopolymer or a propylene/α-olefin random copolymer, the second propylene polymer B having a melt flow rate (MFR, 230° C., 2.16 kg, ISO 1133) of 15 to 120 g/10 min, and/or having a molecular weight distribution (Mw/Mn) in the range of 2.5 to 10.0 (measured by size exclusion chromatography according to ISO 16014).

7. The process according to claim 1, wherein the second propylene polymer B has (i) a melting temperature $T_m$ (DSC, ISO 11357-1 &-2) in the range of 150° C. to 164° C., (ii) a crystallization temperature $T_c$ (DSC, ISO 11357-1 &-2) in the range of 90° C. to 135° C., and (iii) comonomer content<1.0 wt %.

8. The process according to claim 1, wherein the second propylene polymer B has (i) a melting temperature $T_m$ (DSC, ISO 11357-1 &-2) in the range of 142° C. to 155° C., (ii) a crystallization temperature $T_c$ (DSC, ISO 11357-1 &-2) in the range of 80° C. to 125° C., and (iii) a comonomer content 1.0-5.5 wt %.

9. The process according to claim 1, wherein the first propylene polymer A and second propylene polymer B are different, and at least one of the propylene polymers (A and B) is visbroken.

10. The process according to claim 1, wherein only one of the propylene polymers (A and B) is visbroken, and the absolute value of the difference of Mz/Mw between propylene polymer A and propylene polymer B is from 0.3 to 10.0.

11. The process according to claim 1, wherein both of the propylene polymers (A and B) are visbroken, and the absolute value of the difference of Mz/Mw between propylene polymer A and propylene polymer B is from 0.0 to 0.3.

12. The process according to claim 1, wherein at least one of the propylene polymers A and B is nucleated, and the amount of nucleating agent is between 0.01-5000 ppm based on the total amount of the nucleated propylene polymer.

13. The process according to claim 1, wherein the first propylene polymer A is a propylene homopolymer and the second propylene polymer B is a propylene/a-olefin random copolymer.

14. The process according to claim 12, wherein the amount of first propylene polymer A is less than the amount of second propylene polymer B.

* * * * *